US005441316A

United States Patent [19]

Georgopoulos

[11] Patent Number: 5,441,316

[45] Date of Patent: Aug. 15, 1995

[54] SEAL

[75] Inventor: George Georgopoulos, Pine Brook, N.J.

[73] Assignee: E. J. Brooks Company, Newark, N.J.

[21] Appl. No.: 72,501

[22] Filed: Jun. 4, 1993

[51] Int. Cl.[6] ..... B65D 27/30

[52] U.S. Cl. ..... 292/320; 292/307 A; 292/325

[58] Field of Search ..... 292/320, 321, 322, 319, 292/325, 307 A, 307 R; 24/16 PB

[56] References Cited

U.S. PATENT DOCUMENTS

| | | | |
|---|---|---|---|
| 3,149,869 | 9/1964 | Chamberlin | 292/320 |
| 3,367,701 | 2/1968 | Wenk . | |
| 3,712,655 | 1/1973 | Fuehrer | 292/321 |
| 3,757,936 | 9/1973 | Lindegren . | |
| 4,106,801 | 8/1978 | De Lima Castro Neto . | |
| 4,175,782 | 11/1979 | de Lima Castro Neto . | |
| 4,221,409 | 9/1980 | Harley | 292/322 |
| 4,818,002 | 4/1989 | De Lima Castro Netto . | |
| 5,118,148 | 6/1992 | Netto | 292/325 X |

FOREIGN PATENT DOCUMENTS

| | | | |
|---|---|---|---|
| 1594207 | 7/1981 | United Kingdom | 292/320 |

OTHER PUBLICATIONS

Catalog (2 pages) No. 262 (2500) 2/83 Poly-lok (sheet 2).

Poly-lok No. 283 10/82.

Poly-lok II No. 311 6/84.

Sure Lock Door Seal No. 277 4/84.

*Primary Examiner*—Rodney M. Lindsey

*Attorney, Agent, or Firm*—William Squire

[57] ABSTRACT

A thermoplastic unitary molded seal comprises a tab, a socket depending from the tab, a pair of links extending from the tab and a locking member secured to the other end of the links. A tether is secured at one end to the locking member adjacent to one of the links and at another end adjacent to the other of the links. The tether is attached at one of its ends by a reduced cross-section to permit the tether to be severed from the locking member. The locking member comprises a pair of resiliently secured tangs attached to a cross-member in which there are a pair of recesses and a transverse hole. The recesses and hole receive the tether therethrough. The recesses and hole are inserted within the cavity of the socket with the tether free end inserted so as to lock the tether within the recesses and hole. The tether includes at least a pair of projections, one projecting from the tether on each side of the locking member so that when the tether is locked to the locking member in the socket the tether cannot be removed. The tangs include rearward facing projections which engage mating recesses in the socket. In a further embodiment, the socket has apertures at the bottom region thereof for receiving the tang tips for providing visual evidence of tampering, the tangs displacing in the socket while locked.

9 Claims, 4 Drawing Sheets

SEAL

FIELD OF INVENTION

This invention relates to seals and, more particularly, to thermoplastic seals of the type having a locking arrangement including a tang at one end of a strap and a socket at the other end of the strap into which the tang is inserted and is permanently locked.

BACKGROUND OF THE INVENTION

Such seals, sometimes referred to as self-locking seals, typically comprise a body generally molded thermoplastic which has a female socket therein having a recess. A strap is attached to the body and has at its free end typically a pair of tangs, which being molded thermoplastic, are somewhat resilient. The tangs are inserted into the socket in interference fit so that the tangs are compressed during insertion. Once the tangs are inserted into the socket cavity which is enlarged relative to the egress of the cavity, they expand inside the cavity. Once the tangs expand inside the cavity, they engage with shoulders formed by the cavity egress precluding removal from the socket. For example, in U.S. Pat. No. 3,367,701 such a seal is illustrated. Also as illustrated in this patent is an abutment which is located within the cavity for spreading the tangs apart so as to preclude reverse removal of the tangs once inserted and locked into the recess. Other self-locking security seals are disclosed in U.S. Pat. Nos. 4,106,801; 4,818,002; 4,175,782; 5,118,148; and 3,149,869. Several of the above patents disclose an arrangement in which a set of tangs are attached to one end of a strap and a body including a socket is attached to another end of the strap, the entire arrangement being molded thermoplastic. The tang arrangement is inserted and locked to a cavity in the socket.

The present inventor recognizes a need for an approved seal employing a locking arrangement such as disclosed in the aforementioned patents. One problem recognized is that it is desirable to provide tamper evidence when a lock has been broken into and the seal has been somewhat reassembled to hide the fact that the seal has been broken into. For example, in all of the seals disclosed above if a strap portion is broken and the tangs removed, it would be difficult to visually identify that the tangs are still locked in place in the arrangement if the strap is reinserted into the socket and glued in place without the tangs intact. A second problem is that in many cases the seals are employed in the transportation industry where the seals are used to lock doors of trucks and the like using the hasps of the truck doors holding the cargo. The driver of the truck needs to carry extra seals so that on the return trip the driver can reseal the truck doors after the truck has been unloaded and reloaded at a first destination. The present inventor recognizes a desirability of reducing the number of extra seals that a driver has to carry in order to provide a locking seal for the driver after a seal has been used and broken open to permit unloading of cargo and, thus, requiring a second new seal for resealing any cargo.

Another problem recognized is that sometimes the tang and socket arrangements at either end of a strap are relatively large and cannot pass through relatively small openings. A need is seen for providing a thermoplastic seal of the type described which can be used with relatively small openings employing the structure comprising tangs and a mating socket. Further, a need is seen for providing a seal which comprises an integral structure so that all of the components are joined and can not be lost with respect to one another during use. Another problem recognized with prior art seals is tampering. It is desirable to provide a pick-proof seal. The present inventor recognizes that a pick which can be inserted in the socket may be utilized to flex the mating locking tang to a point where it can be removed. A need is seen for a solution to the above problems.

SUMMARY OF THE INVENTION

A seal construction in accordance with one embodiment of the present invention comprises a socket member having a socket cavity defining at least one locking recess. A locking member including at least one locking tang is dimensioned to be inserted in the cavity and mate with the at least one locking recess for locking the locking member to the socket member in the cavity such that the locking member is not generally visible. Means are provided for coupling the locking member to the socket member. The socket member has a tang receiving aperture in communication with the cavity and the ambient atmosphere, the tang including a tip portion. The locking recess is dimensioned relative to the at least one tang for permitting the at least one tang to displace in the locking recess and the tip portion to selectively protrude from the locking recess through the tang receiving aperture into the ambient atmosphere while the tang is locked to the socket member. By permitting the tip portion to selectively protrude from the locking recess an inspector can visually determine whether or not the locking member is still attached to the means for coupling by displacing the locking member and observing the corresponding displacement of the protruding tip.

In another embodiment, an elongated tether is secured at one end to a socket member. The locking member has at least one tether receiving aperture and recess for receiving the tether. The tether receiving aperture and recess are located on the locking member in a position and are dimensioned such that the aperture and recess are located substantially within the socket member cavity when the at least one tang is locked to the at least one locking recess for securing the tether between the locking member and the socket member in the cavity. In this way, the tether may be dimensioned to pass through relatively small openings and then have the free end of the tether locked to the locking member when the locking member is inserted in the socket member cavity.

In a still further embodiment, the socket member has first and second locking cavities each defining at least one locking recess. The locking device includes first and second locking members each including at least one locking tang. Each tang mates with at least one locking recess of one of the socket cavities for locking the locking member to that socket member in the one cavity. Means lock an article to the locking member when the locking member is locked to the socket member. In this way, the seal comprises two independent locking members and mating locking sockets so that the single seal construction can be used several times.

In a still further embodiment, the locking member includes at least one locking tang in which the tang comprises a tip portion and a tail portion resiliently secured to the locking member body. The socket member has at least one locking recess having a first opening of a first transverse dimension in communication with a second opening of a second relatively larger transverse dimension. The first transverse dimension is of a size for resiliently displacing the tang during insertion of the tang into the second opening such that the tang assumes a lock state in the second opening. The second opening has a forward portion and a rear portion. The rear portion has a rearwardly extending recess. The tail portion has a rearwardly extending projection which mates in the rearwardly extending recess in the lock state. The mating engagement of the rearwardly extending projection and the rearwardly extending recess provide a further pick-proof arrangement of the locking member and socket.

IN THE DRAWING

FIG. 1*a* is an isometric view of a seal in accordance with one embodiment of the present invention;

FIG. 1*b* is a side elevation view of the embodiment of FIG. 1*a;*

Figure 1A:
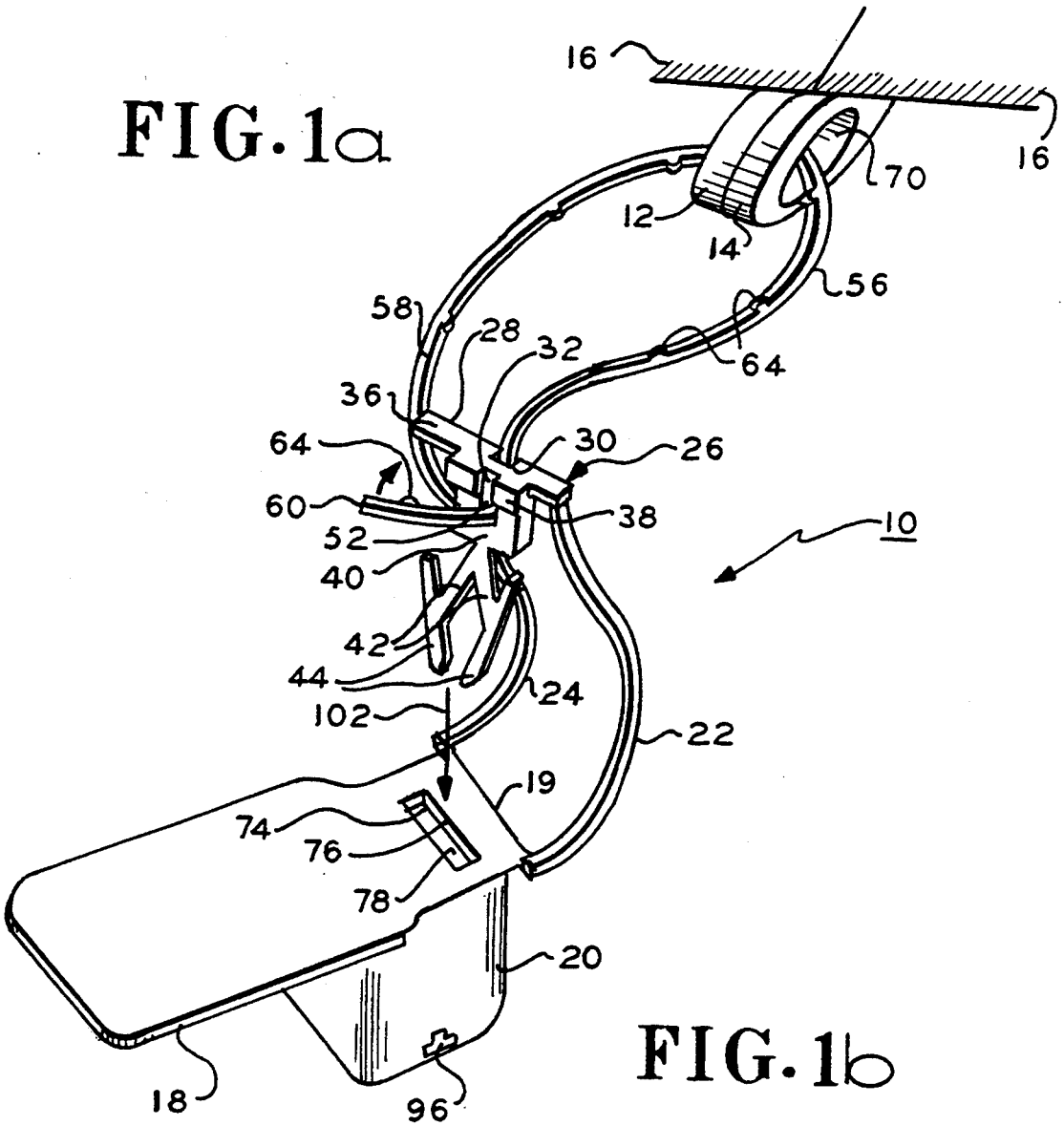
Figure 1B:
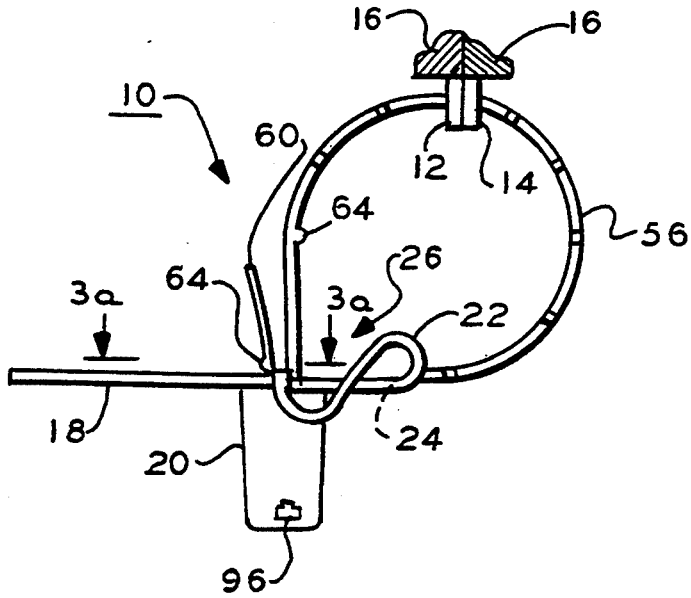
Figure 3:
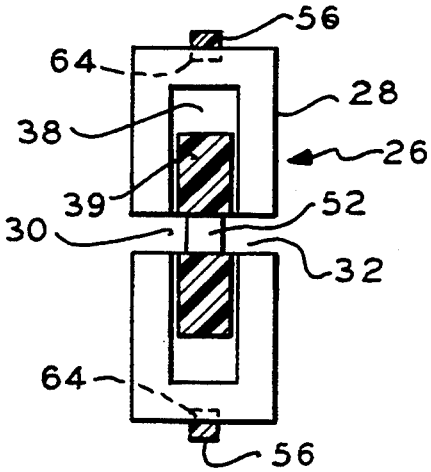
FIG. 3 is a sectional elevation view taken along lines of 3—3 of FIG. 2.
Figure 3A:
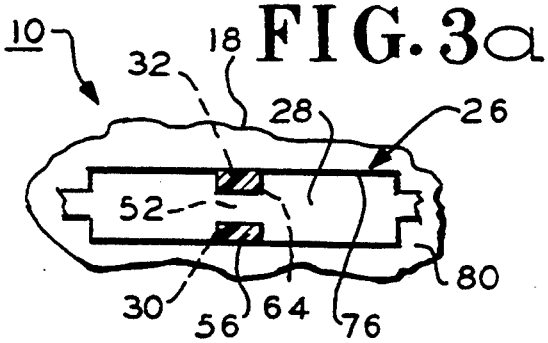

FIG. 3*a* is a sectional plan view taken along lines 3*a*—3*a* of FIG. 1*b;*

Figure 2:
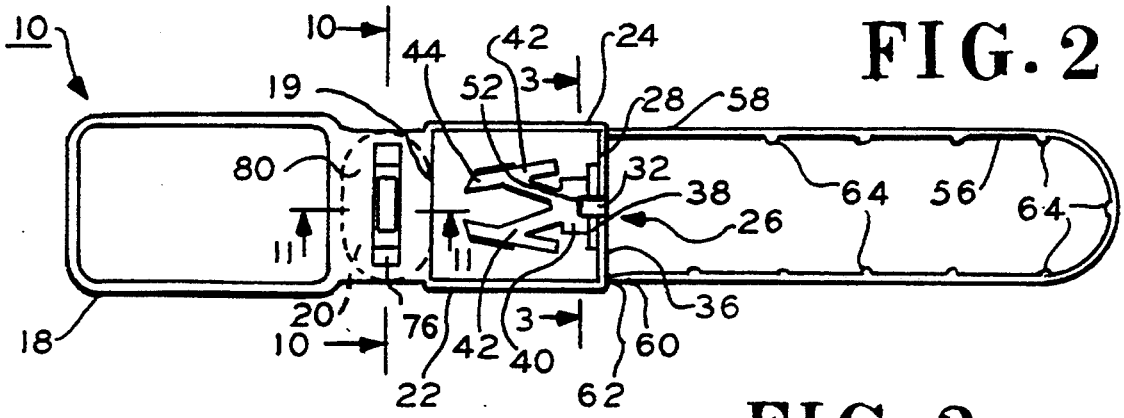
FIG. 2 is a plan view of the seal of the embodiments of FIG. 1*a* and 1*b* prior to use in a locking configuration.
Figure 4:
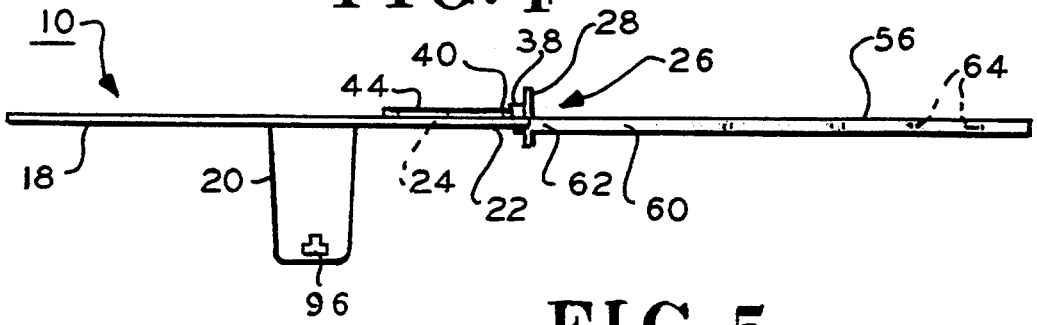
Figure 5:
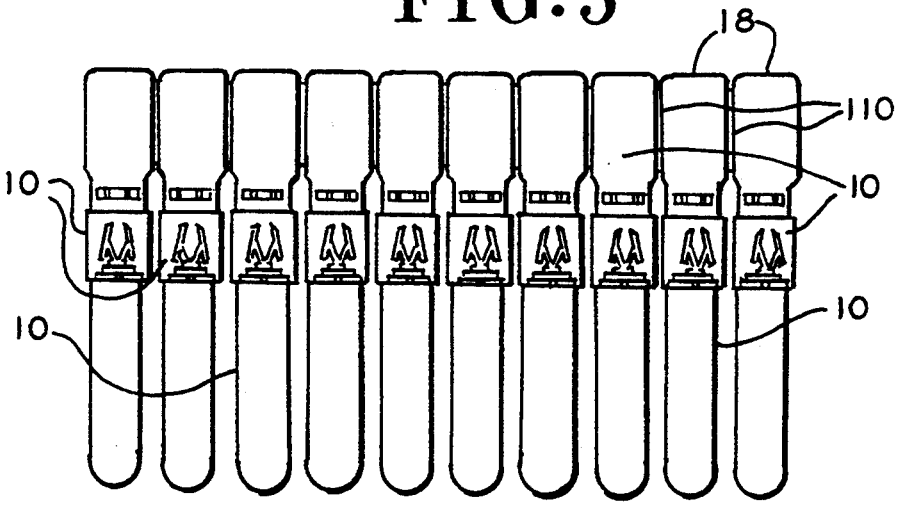
Figure 6:
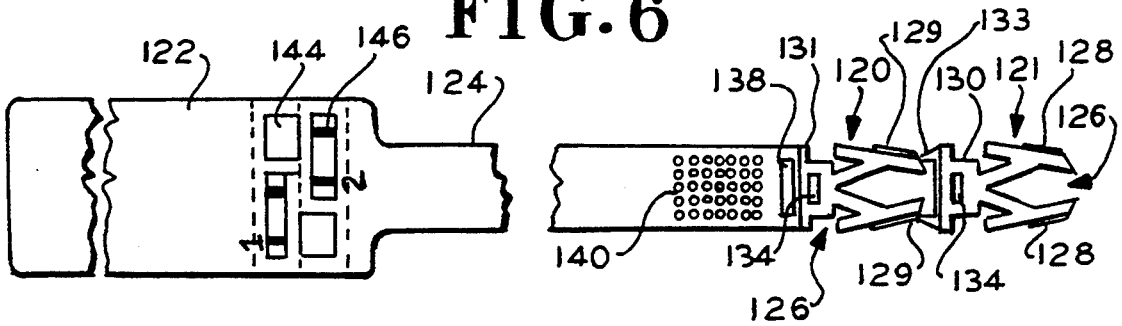
Figure 7:
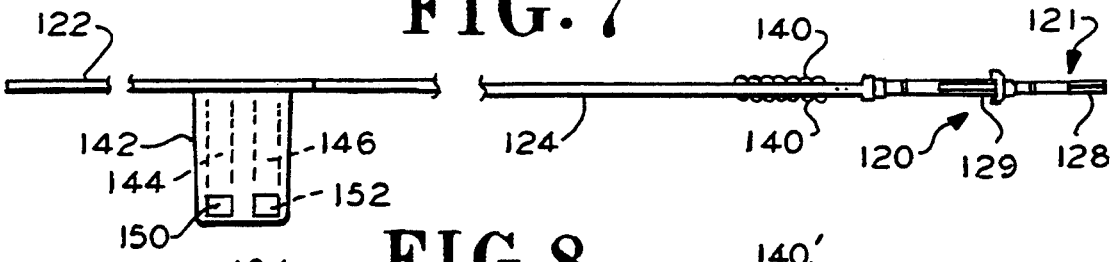
Figure 8:
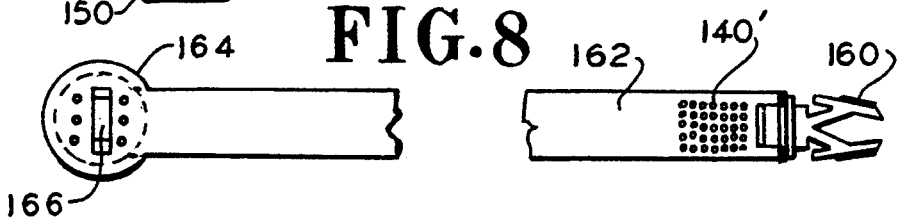
Figure 9:
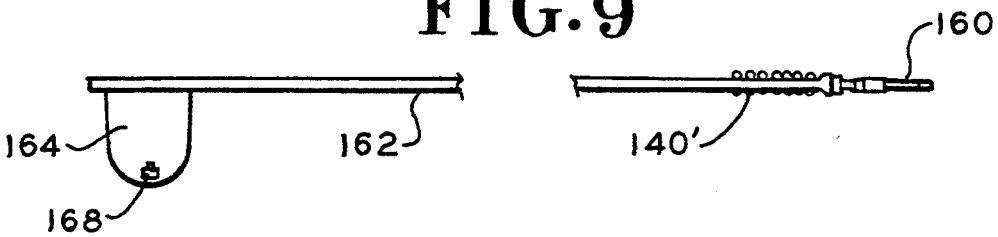
Figure 10:
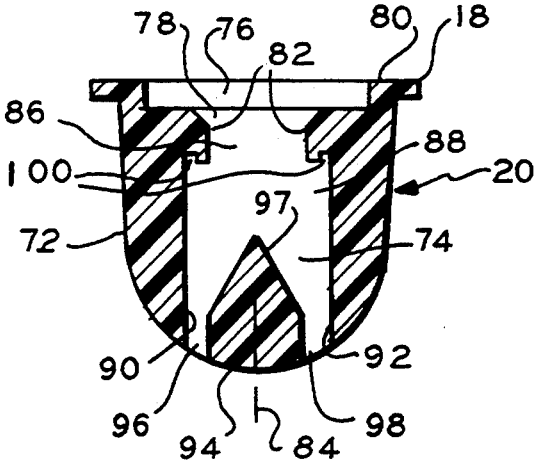
Figure 11:
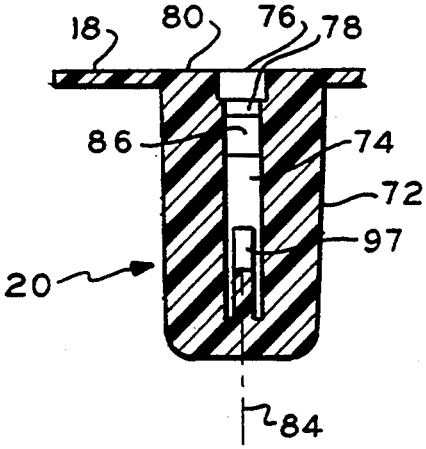
Figure 12:
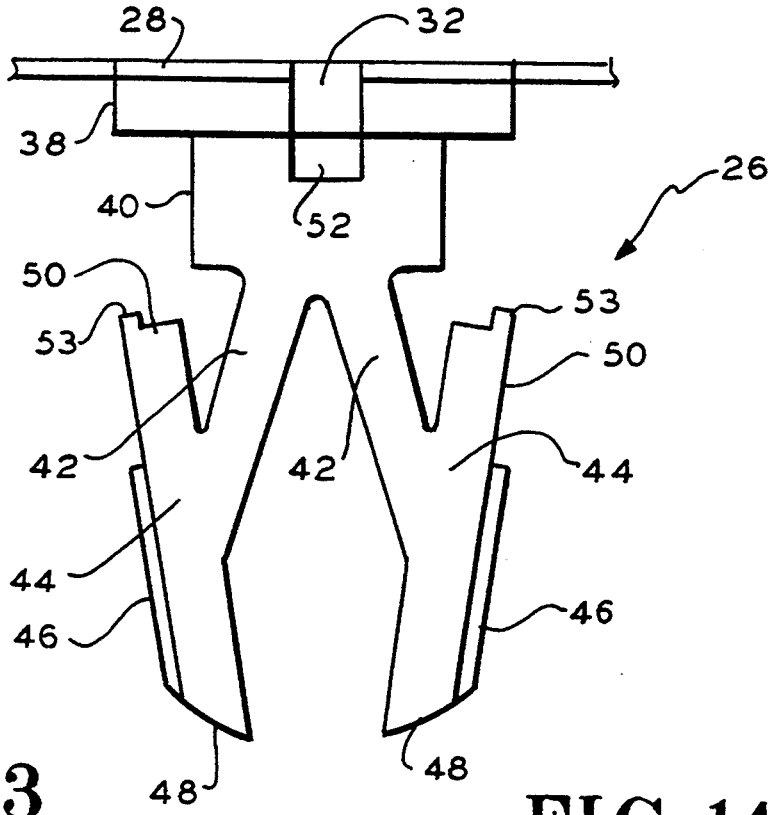
Figure 13:
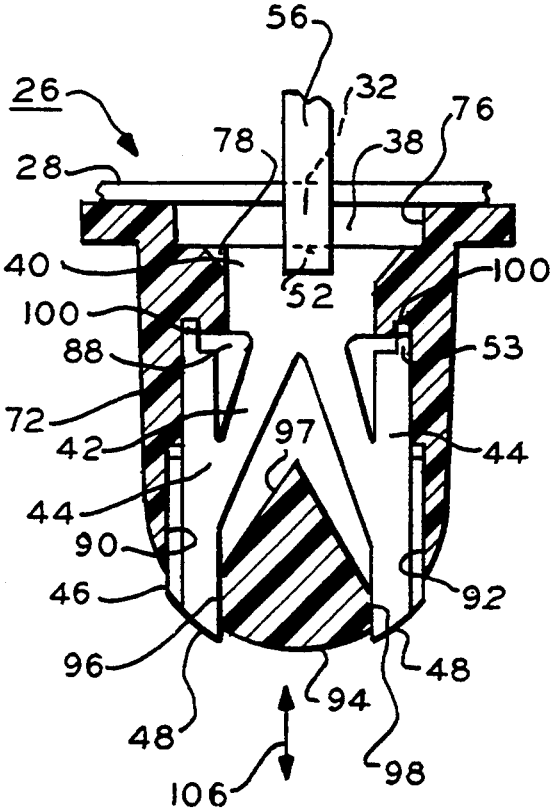
Figure 14:
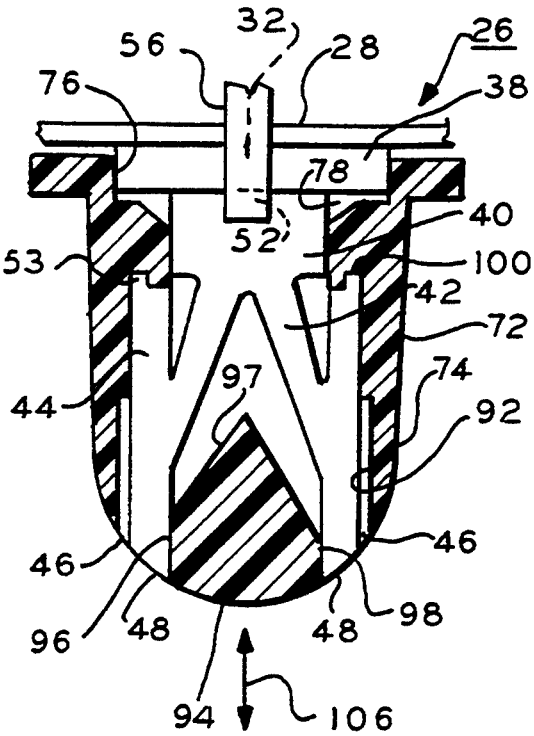

FIG. 4 is a side elevation view of the embodiment of FIG. 2;

FIG. 5 is a plan view of the embodiment of FIG. 2 in which the embodiment is molded in multiple sets;

FIG. 6 is a fragmented plan view of a seal according to a second embodiment of the present invention;

FIG. 7 is a side elevation view of the embodiment of FIG. 6;

FIG. 8 is a plan fragmented view of a seal according to a third embodiment of the present invention;

FIG. 9 is a side elevation view of the embodiment of FIG. 8;

FIG. 10 is a sectional elevation view of the embodiment of FIG. 2 taken along lines 10—10;

FIG. 11 is a sectional elevation view of the embodiment of FIG. 2 taken along lines 11—11;

FIG. 12 is an enlarged more detailed elevation view of the tang portion of the seal of the embodiments of FIGS. 1*a* and 8; and FIGS. 13 and 14 are respective sectional elevation views similar to the view of FIG. 10 with a locking tang secured in a locking socket to illustrate different relative positions of the locking tangs to the socket to show protrusion of the tang tips from apertures in the socket to provide tamper evidence.

DESCRIPTION OF THE PREFERRED EMBODIMENTS

In FIGS. 1*a* and 1*b*, seal 10 is shown locking two hasps 12 and 14 secured to a support 16 such as corresponding doors or panels or the like which are to be secured together. The seal 10 comprises a planar tab 18 from which depends a socket 20. A pair of flexible links 22 and 24 are integral with the tab 18. The links 22 and 24 are spaced from each other at opposite sides of the tab 18 and end 19.

A locking member 26 is secured to the other ends of links 22 and 24. Preferably the links 22, 24 and locking member 26 including tab 18 and socket 20 are all molded thermoplastic material formed as a single integral unit as illustrated in FIGS. 2 and 4.

In FIG. 2, the locking member 26 comprises a crossmember 28, rectangular in cross-section, secured at its opposing ends to a different one of the ends of links 22 and 24 distal tab 18 end 19. The crossmember has a pair of like recesses 30 and 32, rectangular in cross-section, on opposite sides of the crossmember 28 extending in a direction parallel to links 22 and 24. The recesses 30 and 32 are perpendicular to planar end surface 36 of crossmember 28. The crossmember 28 includes a rectangular projection 38 in which the recesses 30 and 32 are formed on each side of the member 28. A rectangular in cross-section projection 40 depends from and converges toward rectangular projection 38. A V-shaped member comprising legs 42 depend from projection 40. As shown in more detail in FIG. 12, a pair of tangs 44 each depend from the extended end of a different one of the legs 42. The tangs 44 are identical and are attached to the legs 42 in mirror image fashion. Each tang 44 comprises an elongated rectangular in section member which is attached somewhat centrally to an end of a leg 42. A rectangular in section rib 46 projects lengthwise along the outer side length of each tang 44 from a surface thereof opposite the member 42. The rib 46 extends from the member 44 tip 48 upward to about a mid-section of the corresponding tang 44. The tip 48 is curved somewhat to blend in with the socket 20 bottom surface 94, FIG. 13. The tail portion 50 of each tang 44 includes a rearwardly extending projection 53. The rib 46 may be somewhat thinner in a direction into the drawing of FIG. 12 than the tang 44. A rib 46 and projection 53 are on each of the tangs 44.

A rectangular in cross-section hole 52 is in communication with each of the recesses 30 and 32. The hole 52 is formed in the projection 40 next adjacent to recesses 30 and 32 as best seen in FIG. 3. The projections 38 and 40 and member 28 form a somewhat stepped arrangement as seen in FIG. 2. The hole 52 provides communication between the recesses 30 and 32 on each side of member 28. A tether 56, rectangular in cross-section of about the same dimensions as recesses 30 and 32, is secured at one of its ends 58 to member 28 adjacent to an end of link 24 and at its other end 60 to member 28 adjacent to an end of link 22. The end 60 includes a reduced section 62 which weakens the tether 56 so that the tether 56 may be manually, separated from member 28 at end 60. The tether 56 may be circular in cross-section or other shapes. The tether 56 thus forms a loop as attached to the locking member 28 and is secured to the member 28 only at the tether ends 58 and 60. The end 58 is secured permanently to the member 28 whereas the other end 60 is sufficiently weakened so as to be manually removed upon the finger pressure from the member 28.

The tether 56 includes a plurality of spaced projections 64. The tether 56 has a transverse cross-section area including the projections 64 about the same as the cross-section area of hole 52 so that the tether 56 and projections 64 can pass through the hole 52 from recess 30 to recess 32 or vice versa. However, the recesses 30 and 32 each have a cross-sectional area so that the tether main body portion, excluding the projection 64, can closely be received therein. The cross-section area of the tether through the projections 64 are each sufficiently large relative to the cross-section area of the recesses 30 and 32 such that the projections 64 protrude beyond the recesses 30 or 32 as seen in FIG. 3*a*. As a result, the tether 56 may slide axially via the recesses 30, 32 and hole 52 until that position of the tether where a projection 64 abutts one of the recesses 30 and 32. At this location, the tether can no longer pass through the recesses 30 and 32 when the member 28 is inserted in the cavity of socket 20 (to be described below) as shown in FIG. 3*a*. The socket 20 forms a fourth wall of the channel formed by recesses 30 and 32 forming a hole which is too small to pass tether 56 and a projection 64 therethrough.

In FIG. 1*a*, end 60 has been separated from the member 28 and passed through holes 70 of hasps 12 and 14. The free end 60 of the severed tether 56 is inserted in recess 30, passed through hole 52 and aligned in recesses 30 and 32. The tether 56 is pulled through the hole 50 an amount sufficient to insure that at least one of the projections 64 is on each side of the hole 52 beyond recesses 30 and 32.

In FIGS. 10 and 11 representative socket 20 comprises a thermoplastic molded body 72 which is integral with the tab 18, and has a cavity 74. The cavity 74 has an opening 76 comprising an enlarged egress relative to a smaller tapered egress opening 78, the opening 76 being next adjacent to the external surface 80 of the socket body 72. The opening 76 accommodates the projection 38. A pair of inwardly inclined mirror image projections 82 are in and form the transverse dimension of the opening 78. The projections 82 have inclined upper shoulders and are spaced apart an amount sufficient so as to squeeze the tangs 44, FIG. 12, together during insertion. The tangs are oriented somewhat vertically parallel to axis 84 in the direction of insertion of the tangs and locking member 26 along axis 84. The projections 82 form a relatively narrow neck 86 just following the egress opening 78. The neck 86 accommodates projection 40. The cavity 74 then widens into region 88 for accommodating the tangs 44 in the orientation of FIGS. 13 and 14. The cavity 74, FIG. 10, includes a pair of recesses 90 and 92. The recesses 90 and 92 are each dimensioned to respectively receive a corresponding rib 46 of the tangs 44, FIG. 12. Cavity 74 is in communication with the ambient atmosphere and the bottom surface 94 of socket 20 via openings 96 and 98. The openings 96 and 98 are dimensioned to closely receive the tips 48 of the tangs as shown in FIGS. 13 and 14. The recesses 90 and 92 each also include a further recess 100 on each side of the cavity 74 at the other end of the cavity 74 opposite openings 96 and 98. The recesses 100 are positioned to closely receive the projections 53 of the tangs 44, FIG. 12. A central tapered wedge member 97 wedges the tangs 44 into recesses 90 and 92 during and after insertion.

The central tapered wedge member 97 spreads the tips 48 of the tangs 44 apart and causes them to enter into the openings 96 and 98. The wedge member 97 forces the tangs 44 and the mating ribs 46 into the corresponding recesses 90 and 92 to insure positive locking of the tangs in the cavity 74. Further, the locking projections 53 at the tail end of the tangs 44 are forced against projections 86 in recesses 100, locking the tangs in place and provide further tamper resistance to the removal of the locking member.

In operation, tether 56 is separated at end 60 at weakened portion 62 and inserted through the hole 70 of hasps 12 and 14 FIG. 1*a*. The free end 60 of the tether is then attached to recesses 30 and 32 via hole 52 as seen in FIGS. 1*a*, 1*b*, 13 and 14. At least one of the projections 64 is also passed through the hole 52. In this way, at least one projection 64 is on each side of the member 28 extending beyond a recess 30 and 32. With the tether positioned in the recesses 30 and 32 and hole 52, the locking member 26 is then inserted into cavity 74 via openings 76 and 78 in direction 102, FIG. 1*a*. In this position, the tether cannot be removed from the hole 52 and recesses 30 and 32 due to the projections 64. When the tangs 44 are fully inserted in cavity 74, the projections 53 thereof engage and lock in recesses 100, the ribs 46 engage and lock in recesses 90 and 92 and the locking member 26 is locked in place. With the locking member 26 so locked, the locking member 26 may be displaced in directions 106, FIGS. 13 and 14, without disengaging the locked state of the locking member 26 in the cavity 74. By so displacing the locking member 26, the tips 48 of the tangs 44 can be readily observed to be attached to the tether 56. That is, by displacing the tether 56 in directions 106, the tips 48 when attached to the tether would also displace. Any tampering which severs the tangs from the tether with the tether glued in place would result in the tangs not displacing. The displaceable projection of the tips 48 out of the openings 96 and 98 at the bottom of the cavity 74 therefore provides visual evidence of tampering. The tether 56 is locked in place in recesses 30 and 32 and hole 52 within cavity 74 as described above.

The links 22 and 24 are sufficiently flexible to permit the locking member 26 to be displaced from the flat position of FIGS. 2 and 4 into the bent locking orientation of FIGS. 1*a* and 1*b*. If desired, but not essential, the links 22 and 24 may be severed since these links are thermoplastic material and easily cut. The important aspect is that the entire assembly as shown in FIGS. 2 and 4 is a relatively flat integral structure which can be utilized to provide a seal for threading through relatively small apertures regardless the larger size of the socket 20 and locking member 26. Prior art seals tend to include relatively large straps which are not as easily threaded through relatively small apertures.

In FIG. 5, a plurality of seals 10 are shown molded in an array in which the tabs 18 are molded with a weakened seam 110 between each of the adjacent tabs. The weakened seams 110 can be easily manually severed by hand and the separate seals 10 can then be utilized individually. This results in a convenient molding arrangement in which a large number of seals can be molded simultaneously and remain as a integral package.

In FIGS. 6 and 7, an alternative embodiment is illustrated in which tang devices 120 and 121, tab 122 and strap 124 are constructed somewhat differently than that of the seal 10, FIG. 1*a*. Tang devices 120, 121 are preferably the same structure as those of seal 10 or may be of prior art constructions. Tang devices 120 and 121 are substantially identical and each include a respective set of arm members 126 and 126', to which the respective tangs 128 and 129 are secured. A respective support 130 and 131 supports each of the tangs 128 and 129 at an end of the members 126 and 126', respectively. Supports 130 and 131 may also be identical except that support 130 also supports a second tang support arrangement 133 at the tips of the tangs 129 whereas support 131 is attached to strap 124. Each of the supports 130 and 131 includes an opening 134. The openings 134 serves as a weakening region for selectively permitting the tang device 121 to be severed from the device 120 and device 120 from the strap 124, the tang devices 120 and 121 being attached to one another in serial tandem fashion. Support 130 is attached to the tips of the tangs 129 by arrangement 133 at which the tangs 128 are also severed. A further weakening slot 138 is formed in strap 124 for separating the tang device 120 and support 131 from the strap 124. Strap 124 is significantly larger than the tether 56 of the embodiment of FIG. 1*a*. A plurality of bumps 140 are formed on strap 124 to permit gripping of the strap 124 for insertion of the tang devices 120 and 121 into the mating sockets.

Socket member 142 depends from the tab 122 at the other end of the strap 124. The socket member 142 includes two sockets 144 and 146 secured to the socket member 142 in tandem, as shown. Each of the sockets 144 and 146 are identical and may be identical to the socket 20 of FIGS. 10, 11, 13 and 14. The sockets 144 and 146 are configured to receive and lock the tangs 128 and 129 as shown in FIGS. 13 and 14.

In operation of the embodiment of FIGS. 6 and 7, the tangs 128 of device 121 are inserted in one of the sockets, for example socket 144 to provide a permanent seal. When it is desired to break the seal, the tang device 121 is severed at the tips of the tangs of device 120 at arrangement 133. The tangs 129 remain locked in the socket 144. When it is desired to use the seal of FIG. 6 a second time, the tangs 129 of device 120 are inserted into the second socket 146 to form a second permanent seal. In this way, one seal device can provide a dual seal for permitting a user to use the seal several times.

While two tang devices and two mating sockets are illustrated in the embodiment of FIGS. 6 and 7, it should be appreciated that more than two tang devices and mating number of sockets may be employed in a given seal to perform more than two sealing actions, for example three or more. This is in accordance with a given implementation. In the embodiment of FIGS. 6 and 7, each of the cavities of the sockets 144 and 146 have bottom openings 150 and 152 for receiving the tips of the tangs of the mating tang arrangement.

In FIGS. 8 and 9, a third embodiment is illustrated employing a tang arrangement 160 which is identical to that of the embodiment of FIG. 1. The tang arrangement 160 is attached to a strap 162 which may be identical to the strap 124 of the embodiment of FIG. 6. A socket 164 is attached to the other end of strap 162 without using a tab such as tab 122, FIG. 6, or tab 18, FIGURE la. The socket 164 has a locking member receiving cavity 166 identical to the arrangement of the cavity 74, FIGS. 13 and 14. A pair of bottom openings 168, only one being shown in FIG. 9, is at the base of the socket 164 for receiving the tips of the tang arrangement 160. The bumps 140' on the strap 162 adjacent to the tang arrangement 160 enable firm grasping of the tang arrangement 160 during insertion into the socket 164.

It should be appreciated that modifications and variations to the various embodiments described herein may be made by one of ordinary skill in the art. It is intended that the scope of the present invention is as defined in the appended claims and not by the specific disclosed embodiments.

What is claimed is:

1. A seal construction comprising:

a socket member having a socket cavity defining at least one locking recess:

a locking member including at least one locking tang dimensioned to be inserted in said cavity and mate with said at least one locking recess for locking said locking member to said socket member in said cavity such that the locking member is not generally visible; and means for coupling said locking member to said socket member;

said socket member having a tang receiving aperture in communication with said cavity and the ambient atmosphere, said tang including a tip portion, said locking recess being dimensioned relative to said at least one tang for permitting said at least one tang to displace in said locking recess and said tip portion to selectively protrude from said locking recess through said tang receiving aperture into the ambient atmosphere while said tang is locked to said socket member;

said locking recess comprising a first opening of a first transverse dimension in communication with a second opening of a second relatively larger transverse dimension, said locking member comprising a body, said tang comprising said tip portion and a tail portion resiliently secured to said body, said first transverse dimension being of a size for resiliently displacing the tang during insertion of the tang into said second opening such that the tang assumes a locked state in said second opening, Said second opening having a forward portion and a rear portion, said rear portion having a rearwardly extending recess, said tang tail portion having a rearwardly extending projection which mates in said rearwardly extending recess for locking the tang in the locked state.

2. The seal construction of claim 1 including a pair of said tangs, said socket member having a pair of said at least one locking recess, each corresponding to a different tang and a pair of said tang receiving apertures for receiving a different tip portion.

3. The seal of claim 2 wherein said locking member, means for coupling and said socket member are all molded integral thermoplastic material.

4. The seal of claim 3 wherein said means for coupling is a flat strap having opposing ends, each end secured to a different one of said socket and locking members.

5. The seal construction of claim 11 wherein said locking recess comprises a first channel for receiving said tang in a locking direction and a second channel in communication with the first channel, said tang including a rib upstanding therefrom adapted to engage said second channel in the locked state when the tang is inserted into the first channel in the locking direction.

6. A seal construction comprising:

a socket member having a socket cavity defining at least one locking recess;

a locking member including at least one locking tang dimensioned to be inserted in said cavity and mate with said at least one locking recess for locking said locking member to said socket member in said cavity; and strap means for coupling said locking member to said socket member;

said locking recess comprising a first opening of a first transverse dimension in communication with a second opening of a second relatively larger transverse dimension, said locking member comprising a body, said tang comprising a tip portion and a tail portion resiliently secured to said body, said first transverse dimension being of a size for resiliently displacing the tang during insertion of the tang into said second opening such that the tang assumes a locked state in said second opening, said second opening having a forward portion and a rear portion, said rear portion having a rearwardly extending recess, said tang tail portion having a rearwardly extending projection which mates in said rearwardly extending recess in the locked state;

said socket member having a tang receiving aperture in communication with said cavity, said locking recess being dimensioned relative to said at least one tang for permitting said at least one tang to displace in said locking recess and said tip portion to selectively protrude from said locking recess through said tang receiving aperture while said tang is locked to said socket member.

7. The seal construction of claim 6 wherein said locking recess comprises a first channel for receiving said tang in a locking direction and a second channel in communication with the first channel, said tang including a rib upstanding therefrom adapted to engage said second channel in the locked state when the tang is inserted into the first channel in the locking direction.

8. A seal construction comprising:

a socket member having a socket cavity defining at least one locking recess;

a locking member including at least one locking tang dimensioned to be inserted in said cavity and mate with said at least one locking recess for locking said locking member to said socket member is not generally visible; and means for coupling said locking member to said socket member;

said socket member having a tang receiving aperture in communication with said cavity and the ambient atmosphere, said tang including a tip portion, said locking recess being dimensioned relative to said at least one tang for permitting said at least one tang to displace in said locking recess and said tip portion to selectively protrude from said locking recess through said tang receiving aperture into the ambient atmosphere while said tang is locked to said socket member;

said locking recess comprising a first channel for receiving said tang in a locking direction and a second channel in communication with the first channel, said tang including a rib upstanding therefrom adapted to engage said second channel in the locked state when the tang is inserted into the first channel in the locking direction.

9. A seal construction comprising:

a socket member having a socket cavity defining at least one locking recess;

a locking member including at least one locking tang dimensioned to be inserted in said cavity and mate with said at least one locking recess for locking said locking member to said socket member in said cavity; and strap means for coupling said locking member to said socket member;

said locking recess comprising a first opening of a first transverse dimension in communication with a second opening of a second relatively larger transverse dimension, said locking member comprising a body, said tang comprising a tip portion and a tail portion resiliently secured to said body, said first transverse dimension being of a size for resiliently displacing the tang during insertion of the tang into said second opening such that the tang assumes a locked state in said second opening, said second opening having a forward portion and a rear portion, said rear portion having a rearwardly extending recess, said tang tail portion having a rearwardly extending projection which mates in said rearwardly extending recess in the locked state;

said locking recess comprising a first channel for receiving said tang in a locking direction and a second channel in communication with the first channel, said tang including a rib upstanding therefrom adapted to engage said second channel in the locked state when the tang is inserted into the first channel in the locking direction.

* * * * *

UNITED STATES PATENT AND TRADEMARK OFFICE

CERTIFICATE OF CORRECTION

PATENT NO. : 5,441,316

DATED : August 15, 1995

INVENTOR(S) : George Georgopoulos

It is certified that error appears in the above-indentified patent and that said Letters Patent is hereby corrected as shown below:

Column 8, line 43, Claim 5, line 1, change "11" to -- 1 --.

Signed and Sealed this

Fourteenth Day of November, 1995

Bruce Lehman

*Attest:*

BRUCE LEHMAN

*Attesting Officer*

*Commissioner of Patents and Trademarks*